US006475048B2

(12) United States Patent
Gredy

(10) Patent No.: US 6,475,048 B2
(45) Date of Patent: Nov. 5, 2002

(54) INFLATABLE RAFT TETHERING ARRANGEMENT

(75) Inventor: Debbie L. Gredy, 2001 E. Hillside Dr. 9, Bloomington, IN (US) 47401

(73) Assignee: Debbie L. Gredy, Bloomington, IN (US)

( * ) Notice: Subject to any disclaimer, the term of this patent is extended or adjusted under 35 U.S.C. 154(b) by 0 days.

(21) Appl. No.: 09/798,376

(22) Filed: Mar. 2, 2001

(65) Prior Publication Data

US 2001/0036782 A1 Nov. 1, 2001

Related U.S. Application Data

(60) Provisional application No. 60/186,402, filed on Mar. 2, 2000.

(51) Int. Cl.[7] ..... B63C 9/08

(52) U.S. Cl. ..... 441/129; 441/40; 114/293; 114/230.1

(58) Field of Search ..... 441/129–132, 441/40–42, 23; 114/230.1, 230.2, 230.25, 230.26, 230.3, 293, 294, 296, 345

(56) References Cited

U.S. PATENT DOCUMENTS

| | | | | | |
|---|---|---|---|---|---|
| 3,332,094 | A | * | 7/1967 | Vorenkamp | 441/129 |
| 3,455,571 | A | * | 7/1969 | Dallera et al. | 441/129 |
| 3,858,877 | A | | 1/1975 | Lundstrom | |
| 3,988,020 | A | | 10/1976 | Carter | |
| D267,262 | S | * | 12/1982 | Gorick et al. | D21/237 |
| 4,479,785 | A | | 10/1984 | Tugwood et al. | |
| 4,519,783 | A | | 5/1985 | Burke, Jr. | |
| 4,721,487 | A | * | 1/1988 | Cochran | 441/80 |
| 4,729,331 | A | | 3/1988 | Eggleston | |
| 4,775,346 | A | | 10/1988 | Gunter et al. | |
| 4,799,910 | A | | 1/1989 | Kellough | |
| 4,834,015 | A | | 5/1989 | Alpert | |
| 4,913,672 | A | | 4/1990 | Martin | |
| 4,968,278 | A | | 11/1990 | Lemke et al. | |
| 5,203,860 | A | | 4/1993 | Bollant | |
| 5,273,473 | A | * | 12/1993 | Allen | 441/129 |
| 5,406,653 | A | * | 4/1995 | Todor | 4/496 |
| 5,460,113 | A | | 10/1995 | Gunter | |
| D364,595 | S | * | 11/1995 | Doyle | D12/168 |
| 5,518,431 | A | | 5/1996 | Staley | |
| 5,613,457 | A | * | 3/1997 | Frank et al. | 114/218 |
| 5,676,085 | A | | 10/1997 | Michl, Jr. | |
| 5,713,773 | A | | 2/1998 | Churchill | |
| D392,231 | S | * | 3/1998 | Vaughn | D12/168 |
| 5,810,632 | A | * | 9/1998 | Huston, III | 441/129 |
| 6,176,815 | B1 | * | 1/2001 | Riera | 482/55 |

FOREIGN PATENT DOCUMENTS

| | | | | |
|---|---|---|---|---|
| FR | 1096550 | * | 6/1955 | 441/40 |

* cited by examiner

*Primary Examiner*—S. Joseph Morano
*Assistant Examiner*—Ajay Vasudeva
(74) *Attorney, Agent, or Firm*—Maginot, Moore & Bowman, LLP

(57) ABSTRACT

An inflatable raft tethering arrangement includes an inflatable raft and a tether. The inflatable raft has an aperture and a rigid reinforcement. The rigid reinforcement is disposed about the aperture. The tether includes a clasp, a cord, and a suction mechanism. The clasp is secured to the raft through the aperture and the cord secured to the clasp and the suction mechanism.

16 Claims, 5 Drawing Sheets

INFLATABLE RAFT TETHERING ARRANGEMENT

This application claims the benefit of U.S. Provisional Patent Application Ser. No. 60/186,402, filed Mar. 2, 2000.

FIELD OF THE INVENTION

The present invention relates generally to the field of inflatable rafts.

BACKGROUND OF THE INVENTION

Inflatable rafts are typically used in recreational swimming pools as well as other bodies of water as a means to provide flotation to a user. An inflatable raft is usually constructed of polymeric material that has an interior that receives air through a nozzle. As the raft receives air, in inflates to the inflated state in which it is typically bouyant enough to allow the user to float on water when resting on the raft.

While the raft is afloat, it is subject to currents within the body of water. As a result, if the user intends to remain in the same general area, the user may be required to actively navigate the raft to stay in the desired area. This is undesirable in many cases as one of the primary uses of inflatable rafts is to allow the user to relax.

To facilitate stationary positioning of an inflatable raft, anchoring arrangements have been developed. For example, U.S. Pat. No. 4,775,346 to Gunter et al. shows a raft tethered to the side of a pool using straps. The straps attach to the raft using fabric hook and loop fasteners. The raft-side of the fastener is attached to the raft via an adhesive. The straps attach to the pool side by use of a suction mechanism. While the Gunter anchoring arrangement advantageously eliminates raft drift, it undesirably relies upon adhesives to secure the fastener to the raft. The use of adhesives, which must be water insoluble and resilient, raises manufacturing issues and possibly environmental issues. Moreover, hook and loop fasteners can have reduced effectiveness after several uses, and typically have limited retention capabilities. Still another drawback of the Gunter arrangement arises from the use of flat straps in connection with the hook and loop fastener. In particular, the flat straps must be affixed to the pool side in a particular alignment to achieve proper alignment of the strap-side fastener with the raft-side fastener.

U.S. Pat. No. 4,729,331 to Eggleston shows another raft anchoring device that attaches to the bottom of a pool. Instead of a hook and loop fastener, the Eggleston anchoring arrangement employs a "snap" or clasp fastener similar to that used to secure pet animals to tethers. While the snap fastener overcomes the retention effectiveness issues of hook and loop fasteners employed in the Gunter anchoring arrangement, the Eggleston arrangement nevertheless undesirably relies on adhesives to affix a fastener pad to the raft. In particular, the fastener pad of Eggleston contains the hole that receives the snap fastener and thus allows the anchoring arrangement to be secured to the raft. In addition to the drawbacks of adhesive use, the fastener pad in which the hole is formed may tear from repeated use. Moreover, the Eggleston device consists of only a long, single tether. As a result, the raft is largely free to rotate about the tether, which may be undesirable in a crowded pool environment.

Accordingly, there is a need for a device that tethers an inflatable raft to a stationary object that does not rely on water resistant adhesives to secure the tether to the raft. There is a further need for a device that at least optionally constrains the rotation motion of the inflatable raft and which is otherwise easy to configure and use. There is also a need for an anchoring device that has a secure and robust attachment to an inflatable raft that is resistant to failure after repeated use.

SUMMARY OF THE INVENTION

The present invention addresses the above needs, as well as others, by providing a tethering arrangement that preferably includes a clasp that attaches to a reinforced aperture on the raft. Optionally, the reinforced aperture is formed in an integral portion of the raft material. Also preferably, the raft includes a plurality of reinforced apertures located at distinct locations on the periphery of the inflatable raft to allow the raft to be tethered at more than one point to reduce rotational travel.

A first exemplary embodiment of the present invention is an inflatable raft tethering arrangement that includes an inflatable raft and a tether. The inflatable raft has an aperture and a rigid reinforcement. The rigid reinforcement is disposed about the aperture. The tether includes a clasp, a cord, and a suction mechanism. The clasp is secured to the raft through the aperture and the cord secured to the clasp and the suction mechanism.

The above embodiment provides better strength and integrity of the tethering arrangement through the use of the rigid reinforcement, which may suitably be a grommet.

A second exemplary embodiment of the present invention is an inflatable raft tethering arrangement that also includes an inflatable raft and a tether. The inflatable raft has an aperture and an integral uninflatable peripheral portion. The aperture is formed in the uninflatable peripheral portion. The tether includes a clasp, a cord, and a suction mechanism. The clasp is secured to the raft through the aperture and the cord secured to the clasp and the suction mechanism.

The above embodiment provides, among other things, a tethering arrangement that does not rely on adhesives because the aperture through which the clasp is received is formed integrally into an uninflatable peripheral portion of the raft.

Other embodiments optionally include an elastic cord, multiple tethers, and/or a pliable clamp that assists in securing the tether cord to the suction mechanism.

The above discussed features and advantages, as well as others, will become more readily apparent to those of ordinary skill in the art by reference to the following detailed description and accompanying drawings.

DETAILED DESCRIPTION OF THE PREFERRED EMBODIMENT

Figure 1:
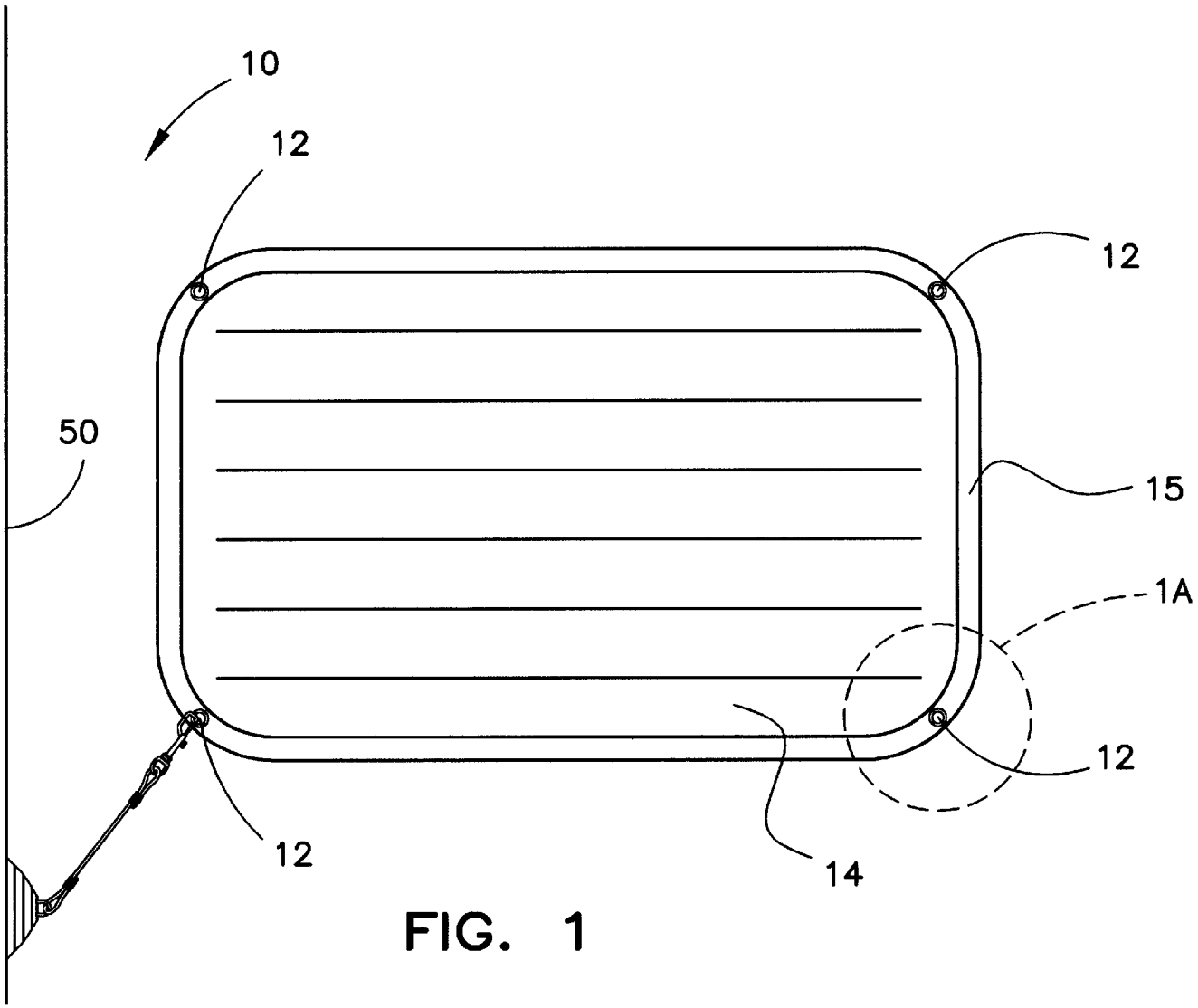
FIG. 1 shows a top plan view of an exemplary inflatable raft tethering arrangement of the present invention.

While the invention is susceptible to various modifications and alternative forms, a specific embodiment thereof has been shown by way of example in the drawings and will herein be described in detail. It should be understood however, that there is no intent to limit the invention to the particular form disclosed, but on the contrary, the intention is to cover all modifications, equivalents, and alternatives falling within the spirit and scope of the invention as defined by the appended claims.

Referring now to FIG. 1, there is shown a tethering arrangement 10 which incorporates the features of the present invention therein. The tethering arrangement 10 includes a raft 14, a tether 100, and a pool side 50.

Figure 3:
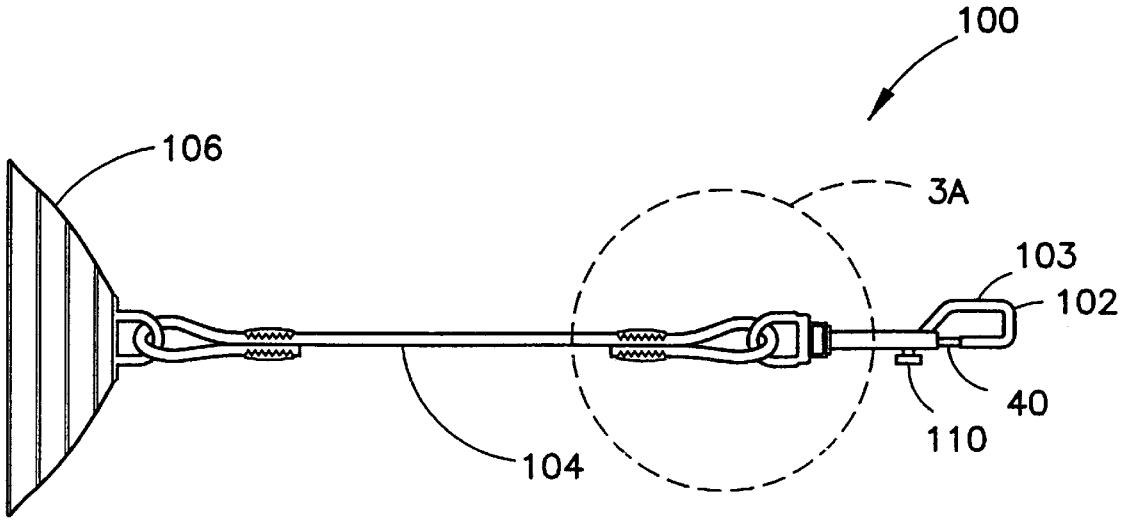
FIG. 3 shows a perspective view of an exemplary tether that may be used in the inflatable raft tethering arrangement of FIG. 1.

The tether 100 includes a clasp 102, a cord 104, and a suction mechanism 106. (FIG. 3) The suction mechanism 106 may suitably be a suction cup and is biased to assume the approximate shape of a cone. The suction mechanism 106 may, for example, be the model Giant 5750-00 suction cup available from Adams Mfg. Corp. of Portersville, Pa. When the suction mechanism 106 is applied to a flat surface such as a pool side 50, the suction mechanism 106 compresses and the bias of suction the mechanism 106 creates a vacuum between section mechanism 106 and the pool side 50 so as to operatively secure suction mechanism 106 to the pool side 50. The suction mechanism 106 is further operatively coupled to the cord 104 by placing the cord 104 through an aperture defined in the suction mechanism 106 by an anchor loop 107 and fixedly coupling the cord 104 to itself by the use of a pliable clamp 108 as shown in FIG. 3. The anchor loop 107 is preferably integrally formed with the suction mechanism 106. The cord 104 is coupled to the clasp 102 in the same manner, using a pliable clamp 108.

Figure 3A:
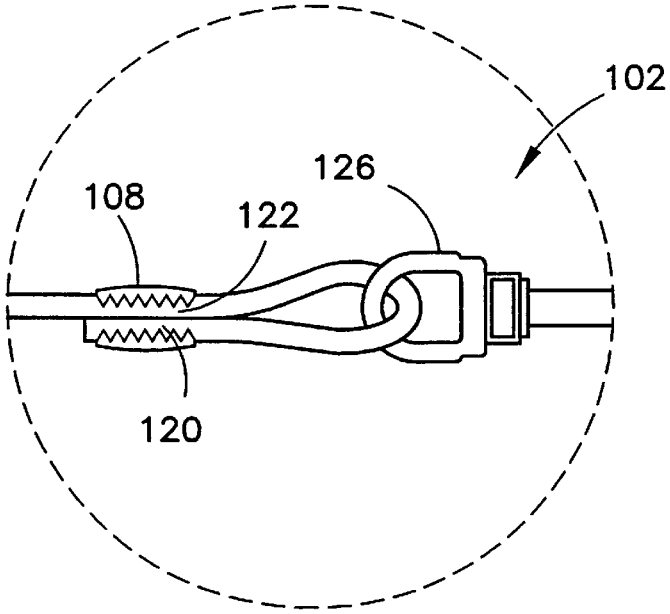
FIG. 3*a* shows a fragmentary enlarged view of a portion of the tether of FIG. 3.

FIG. 3A shows in further detail one of the pliable clamps 108 that secures the cord 104 to the clasp 102. In particular, the cord 104 includes an end portion 120 and an inward portion 122. The pliable clamp 108 secures the end portion 120 to the inward portion 122, thereby forming a loop 124. The loop 124 travels through an aperture defined by an anchor loop 126 on the clasp 102, thereby interlocking the cord 104 to the clasp 102.

The cord 104 may be an elastic "bungee" type cord such that is stretchable, but is biased to return to its original length in the absence of an opposing force. The use of the elastic cord allows for some shock absorption in the tether. In particular, if a person is on the raft 14 and water currents tend to push the person to the end of the range of the tether 100, the cord 104, if elastic, flexes so that the travel of the raft 14 is not abruptly halted. However, it will be noted that at least some of the advantages of the present invention may be realized even where the cord 104 is inelastic.

The use of a pliable clamps 108 to couple the cord 104 onto itself after looping the cord 104 through the anchor loops 107, 126 facilitates simple and inexpensive manufacture, particularly where elastic cords are employed. In addition, while a pliable clamp 108 may further be used to secure the cord 104 to the raft 14, it is preferably to employ the clasp 102. In particular, the clasp 102 allow for easy removal of the tether 100 from the raft 14 for occasions in which tethering is not necessary.

To achieve such removability, the clasp 102 forms an enclosed loop 103 has a movable retainer 110 which may be engaged and disengaged so as to close or open the loop 103 respectively. The clasp 102 contains a spring (not pictured) which biases the retainer 110 to the engaged, closed, position. It will be noted that the clasp 102 may take the form of any of several mechanisms that form a looped closure that may be manually opened or released. Such devices are typically biased closed and may be opened via application of manual manipulation. Many clasp mechanisms are spring-biased closed, but others may employ other biasing mechanisms.

Figure 1A:
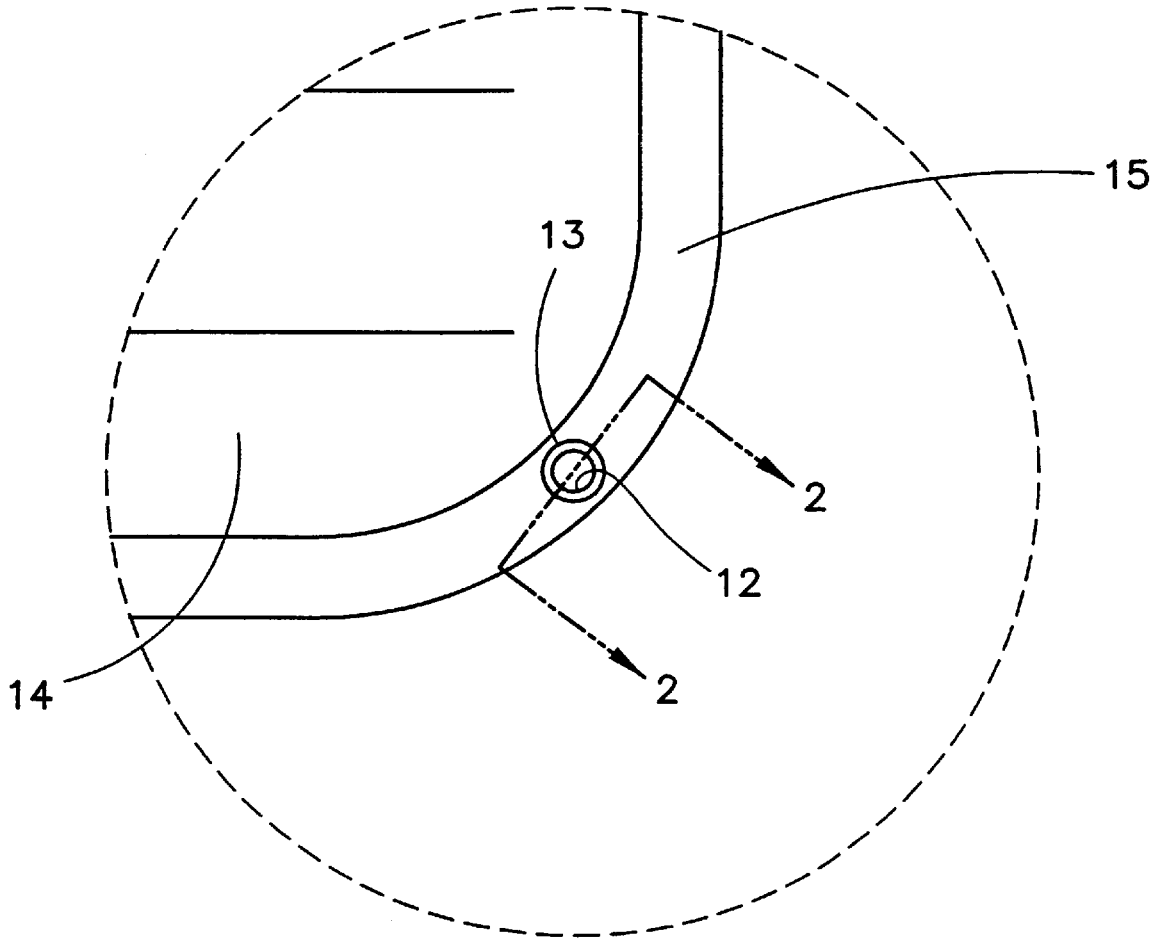
FIG. 1*a* shows a fragmentary enlarged view of a portion of the inflatable raft tethering arrangement of FIG. 1.
Figure 2:
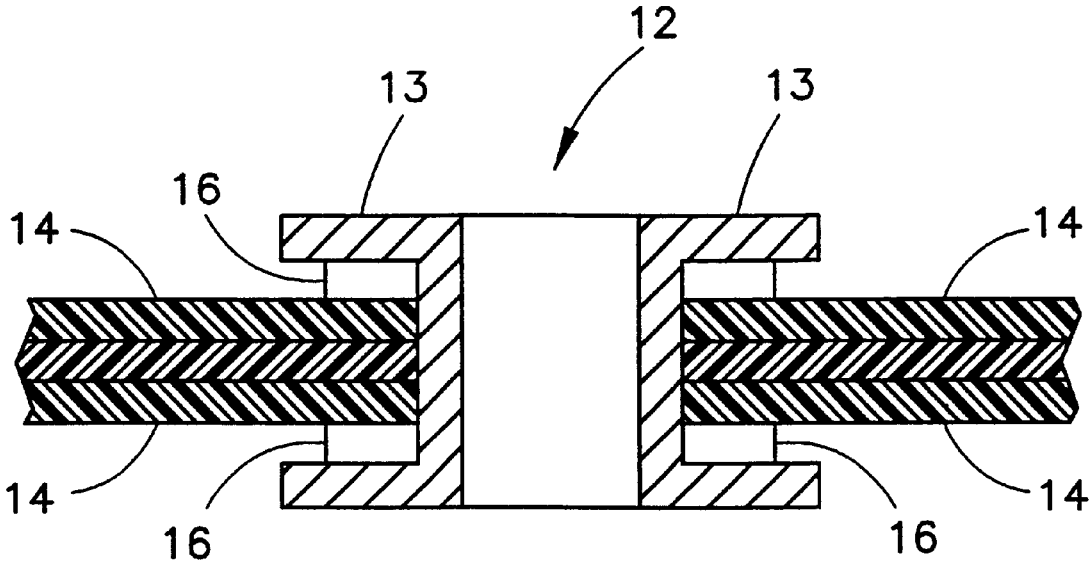
FIG. 2 shows a fragmentary cross sectional view of a portion of the inflatable raft tethering arrangement of FIG. 1.

The raft 14 may suitably be a standard inflatable raft formed of a flexible, relatively air-tight material. The raft 14 is preferably constructed such that the cumulative density of the raft 14 in a substantially inflated state and a user is less than the density of water. In other words, the raft 14 used in connection with a human being will float on water. The raft 14 includes a plurality of apertures 12 which are located proximate to the corners of the raft 14. As shown in FIGS. 1*a* and 2, a grommet 13 is secured to the raft 14 so as to surround each of the apertures 12. The apertures 12 are suitable for receiving the clasp 102 of the tether 100. The grommets 13 provide additional reinforcement to inhibit tearing of the raft 14 from stress forces applied by the clasp 102 against the material of the raft 14 proximate the apertures 12. The apertures 12 are formed and the grommets 13 are preferably inserted into the raft 14 by piercing the material of the raft 14 and allowing the removal of the material that was previously located in the void space of the grommet 13.

In that rafts are commonly filled with air so as to meet the requirement that the raft 14 and user combination be less dense than water, the piercing of the raft 14 by the grommet 13 must not compromise the airtight seal around the periphery of the raft 14. To this end, the raft 14 is preferably of the type that includes a flat non-inflatable peripheral portion 15 in which the apertures 12 may be formed. Such rafts may be constructed of two polymer sheets that are bonded and/or glued together at the seams (and possibly other places), thereby forming a hollow cavity for holding air required to achieve buoyancy.

In rafts having a non-inflatable peripheral portion 15, however, the grommet 13 may not seat tightly to the peripheral portion 15 because the peripheral portion 15 may be relatively thin. As a result, it may be advantageous to employ one or more spacers 16 between the grommet 13 and the raft 14 in the peripheral portion 15. Spacers 16 may be suitably be formed of a paper or fabric material. It will be noted, however, that in many cases retention of the grommet 13 is typically sufficient without using spacers between the grommet 13 and the peripheral portion 15 of the raft 14.

The use of a grommet 13 and the apertures 12 in integrally formed portions of the raft eliminate the need for gluing additional structures to the raft. Thus, even if the raft itself may be formed with an adhesive, the additional structures for receiving the tether need not rely on the use of adhesives. Moreover, by forming the apertures 12 in a non-inflatable peripheral portion 15 of a standard raft, the complexity of forming an aperture through inflatable portions of the raft is avoided, thereby reducing manufacturing cost.

In addition, while avoidance of adhesives is advantageous, the use of grommets according to the present invention is advantageous even when adhesives are employed. In particular, grommets can provide reinforcement of an aperture in an attachment pad that is affixed to the raft via adhesives. The grommet 13 resists the tendency of the raft to rip from the repeated stress of the clasp 102 pulling against the peripheral portion 15 at the edge of the aperture 12.

The tethering apparatus 10 defines a locus of points where the aperture 12 and therefore the raft 14 may lie. The locus for the aperture 12 roughly approximates a sphere whose radius is the length of the tether 100 and whose center is approximately the center of a suction cup 52 which attaches the tether 100 to the pool wall 50. However, the useful locus will be the intersection of the points in the described sphere with the points in the plane defined by the water level of the pool. The useful locus is further restrained to not include the portion of the pre-described locus which would place the grommet 13 behind or intersecting the pool wall 50.

Figure 1B:
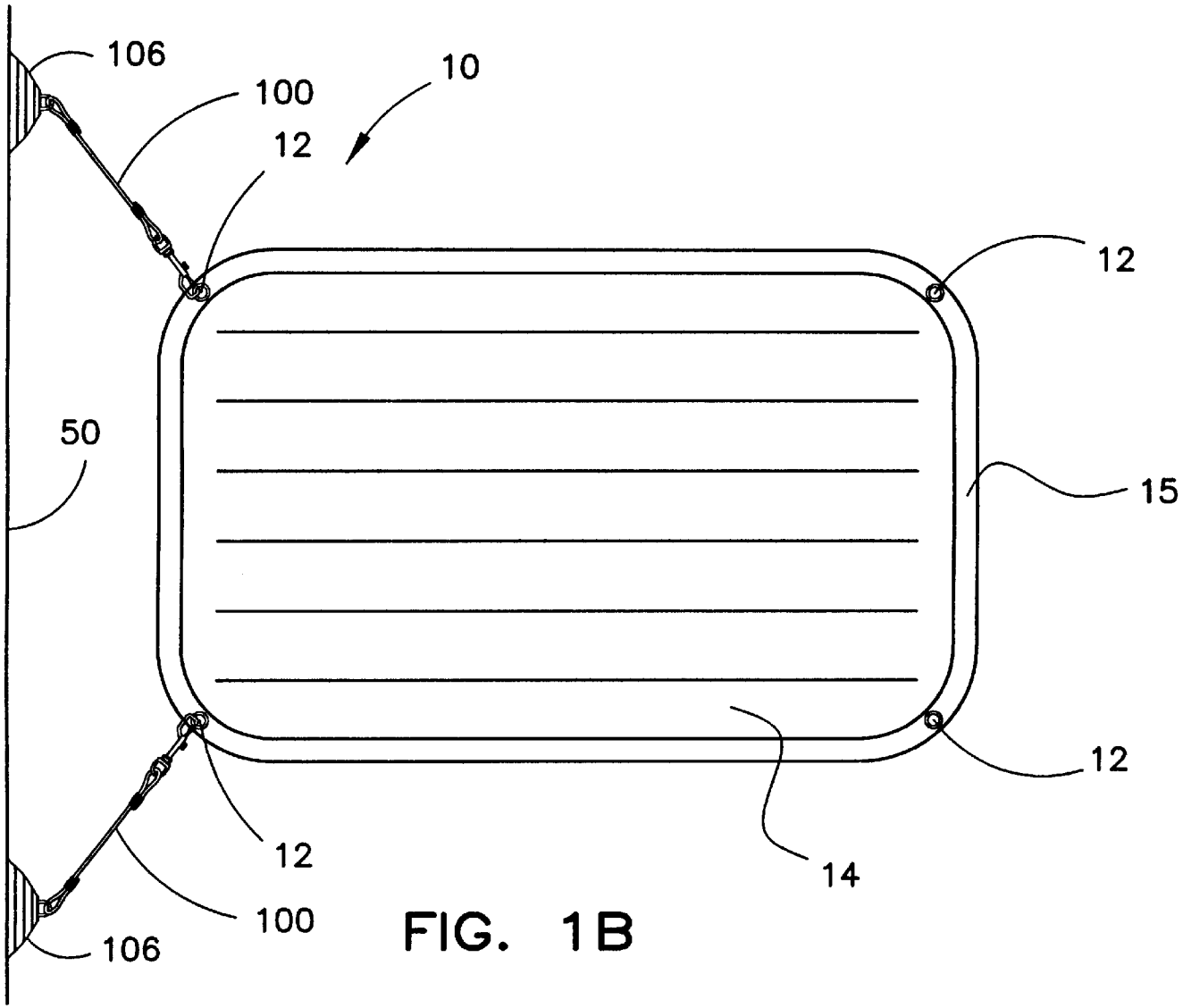
FIG. 1*b* shows a top plan view of an alternative inflatable raft tethering arrangement of the present invention.

It is noted that is some instances, it may be advantageous to use two or more tethers such as tether 100 to secure the raft 14 to the pool wall 50 as illustrated in FIG. 1*b*. To this end, the raft 14 may have multiple apertures 12 as shown. It is noted that the use of two tethers can reduce rotational motion of the unconnected side of raft 14, which may be desirable particularly in a relatively crowded pool. Moreover, multiple tethers may reduce the odds of total detachment of the raft 14 by failure of one of the suction mechanisms 106.

It will also be noted that the tethering apparatus 10 may be used in connection with a watercraft as opposed to a pool. In such a case, the suction mechanism would be affixed to the side of the watercraft. The suction mechanism could also be connected to any other smooth stationary object in or near the water.

It will be appreciated that the use of a grommet for reinforcement is given by way of example only, and has particular advantages in its ease of application. Other reinforcement mechanism including rings of hard plastic, metal or other material may be placed around the aperture using a variety of methods. It is advantageous to employ a reinforcement mechanism is rigid in nature to provide strength.

I claim:

1. An inflatable raft tethering arrangement comprising:

an inflatable raft having an aperture and a rigid reinforcement, the rigid reinforcement disposed about said aperture;

a tether including a clasp, a cord, and a suction mechanism, the clasp secured to the raft through the aperture, the cord secured to the clasp and the suction mechanism; and a pliable clamp, the pliable clamp clamping an end portion of the cord onto an inward portion of the cord, thereby forming a loop, said loop interlocked with an anchor loop on the suction mechanism.

2. The inflatable raft tethering arrangement of claim 1 wherein the rigid reinforcement comprises a grommet.

3. The inflatable raft tethering arrangement of claim 1 wherein the inflatable raft further comprises a plurality of apertures and a plurality of corresponding rigid reinforcements.

4. The inflatable raft tethering arrangement of claim 1 wherein the cord is elastic.

5. The inflatable raft tethering arrangement of claim 1 wherein the aperture is integrally formed with the raft.

6. The inflatable raft tethering arrangement of claim 5 wherein the aperture is formed on an uninflatable peripheral portion of the raft.

7. An inflatable raft tethering arrangement comprising:

an inflatable raft having an aperture and an uninflatable peripheral portion, the aperture integrally formed in the uninflatable peripheral portion;

a tether including a clasp, a cord, and a suction cup, the clasp secured to the inflatable raft through the aperture, the cord secured to the clasp and the suction mechanism; and a pliable clamp, the pliable clamp clamping an end portion of the cord onto an inward portion of the cord, thereby forming a loop, said loop interlocked with an anchor loop on the suction mechanism.

8. The inflatable raft tethering arrangement of claim 7 further comprising a grommet disposed about said aperture.

9. The inflatable raft tethering arrangement of claim 7 wherein the inflatable raft further comprises a plurality of apertures.

10. The inflatable raft tethering arrangement of claim 9 further comprising a second tether, the second tether secured to a second one of the plurality of apertures.

11. The inflatable raft tethering arrangement of claim 7 wherein the cord is elastic.

12. An inflatable raft tethering arrangement comprising:

an inflatable raft having an aperture and an uninflatable peripheral portion, the aperture integrally formed in the uninflatable peripheral portion, the inflatable raft further comprising a rigid reinforcement disposed about said aperture;

a tether including a cord and a suction mechanism, the cord secured to the inflatable raft through the aperture, the cord further secured to the suction mechanism; and a pliable clamp, the pliable clamp securing an end portion of the cord onto an inward portion of the cord, thereby forming a loop, said loop interlocked with an anchor loop on the suction mechanism.

13. The inflatable raft tethering arrangement of claim 12 wherein the cord is elastic.

14. The inflatable raft tethering arrangement of claim 13 further comprising a second tether including an elastic cord secured to a second suction mechanism and a clasp coupled to the elastic cord, wherein the inflatable raft further includes a second aperture and the clasp is coupled to the inflatable raft through the second aperture.

15. The inflatable raft tethering arrangement of claim 12 wherein the inflatable raft further comprises a plurality of apertures.

16. The inflatable raft tethering arrangement of claim 12 further comprising a second tether, the second tether secured to a second one of the plurality of apertures.

* * * * *